US012065219B2

(12) United States Patent
Arnason

(10) Patent No.: US 12,065,219 B2
(45) Date of Patent: Aug. 20, 2024

(54) LOCKING AND STABILISING SYSTEM FOR A STACK OF TUBS IN CARGOHOLD OF A VESSEL

(71) Applicant: Lambhusasund EHF., Akranes (IS)

(72) Inventor: Ingolfur Arnason, Akranes (IS)

(73) Assignee: LAMBHUSASUND EHF, Akranes (IS)

( * ) Notice: Subject to any disclaimer, the term of this patent is extended or adjusted under 35 U.S.C. 154(b) by 338 days.

(21) Appl. No.: 17/432,906

(22) PCT Filed: Feb. 24, 2020

(86) PCT No.: PCT/IS2020/050004

§ 371 (c)(1),
(2) Date: Aug. 20, 2021

(87) PCT Pub. No.: WO2020/170275

PCT Pub. Date: Aug. 27, 2020

(65) Prior Publication Data

US 2022/0204140 A1 Jun. 30, 2022

(30) Foreign Application Priority Data

Feb. 22, 2019 (IS) ..... 050253

(51) Int. Cl.
*B63B 25/24* (2006.01)
*B63B 25/04* (2006.01)
*B63B 35/24* (2006.01)

(52) U.S. Cl.
CPC ..... *B63B 25/24* (2013.01); *B63B 25/04* (2013.01); *B63B 35/24* (2013.01)

(58) Field of Classification Search
CPC ..... B63B 25/00; B63B 25/04; B63B 25/24; B63B 27/00; B63B 35/00; B63B 35/24; B65G 1/00; B65G 1/04
(Continued)

(56) References Cited

U.S. PATENT DOCUMENTS 3,214,057 A 10/1965 Box
4,498,584 A 2/1985 Newbury
(Continued)

FOREIGN PATENT DOCUMENTS

FR 2621567 A1 4/1989
FR 2633898 A1 1/1990
(Continued)

OTHER PUBLICATIONS

International Search Report and Written Opinion dated Jun. 17, 2020 for corresponding International Application No. PCT/IS2020/050003.
(Continued)

*Primary Examiner* — Lars A Olson
(74) *Attorney, Agent, or Firm* — Tarolli, Sundheim, Covell & Tummino LLP

(57) ABSTRACT

The present invention relates to an apparatus and a system for managing and securing cargo tubs in stacks in a cargo hold of a vessel, such as a fishing vessel. The functional components of the apparatus and system comprise means such as rails or transport lanes, wagons and pushing structures as transport means for securely managing stacks of tubs in the cargo hold both during sailing and off-loading.

16 Claims, 6 Drawing Sheets

(58) Field of Classification Search
USPC ..... 114/72
See application file for complete search history.

(56) References Cited

U.S. PATENT DOCUMENTS

| | | | | |
|---|---|---|---|---|
| 5,540,532 | A * | 7/1996 | Carder | B65G 1/0407 414/284 |
| 6,059,521 | A | 5/2000 | Rapeli | |
| 11,919,610 | B2 * | 3/2024 | Arnason | B63B 25/04 |

FOREIGN PATENT DOCUMENTS

| | | | |
|---|---|---|---|
| FR | 2681572 | A1 | 3/1993 |
| WO | 2006074208 | A1 | 7/2006 |

OTHER PUBLICATIONS

Iceland Search Report dated Jun. 27, 2019 for corresponding Application No. SE 2019 00405.

Skaginn3X. Skaginn 3X—Onboard Fish-Hold Robotics. YouTube [online video]. Published May 10, 2017. [Retrieved on Jun. 19, 2019] from the internet: https://www.youtube.com/watch?v=Kf6TGIVdlh4 See 1:19-3:14 minutes.

Skaginn3X. HB Grandi Asbjorn RE50 and Engey RE91. YouTube [online video]. Published Nov. 23, 2017. [Retrieved on Jun. 19, 2019] from the internet: https://www.youtube.com/watch?v=_jJ75_UViZE See 1:30-2:05 minutes.

* cited by examiner

LOCKING AND STABILISING SYSTEM FOR A STACK OF TUBS IN CARGOHOLD OF A VESSEL

RELATED APPLICATIONS

The present application is a U.S. National Stage application under 35 USC 371 of PCT Application Ser. No. PCT/IS2020/050004, filed on 24 Feb. 2020; which claims priority from IS Patent Application No. 050253, filed 22 Feb. 2019, the entirety of both of which are incorporated herein by reference.

FIELD OF INVENTION

The present invention relates to an apparatus, system and method for managing tubs in cargo hold of a vessel. Moreover, the present invention provides a solution for securing and stabilizing tubs and stacks of tubs in a cargo hold of fishing vessel in a safe and organised manner.

INTRODUCTION

Modern fishing vessels are becoming more and more advanced in preparing the fish for storing until it is processed on shore. Such vessels receive the catch on a pre-processing deck where the fish is gutted and bled to preserve the quality of the fish before it is placed in tubs for storage at a temperature close to zero degrees Celsius or even frozen. The value of the catch is increased if the pre-processing is efficient and the fish is bled properly and chilled to meet the expectations of the market.

In some of the more modern vessels it is possible to batch fish on board into tubs based on species, weight etc. WO 2018/185790 discloses such a system for tracing fish from gutting or gilling through batching and cooling using modern imaging technology and the speed of image and data processing to transport each fish under an image detecting device and obtain images to estimate size, weight, species and condition of fish prior to batching. After going through that process each batch of fish must be stored in a separate receptacle until delivered at shore.

Fish is normally kept in tubs during storing and transportation on fishing vessels. The tubs are normally stackable, such that the bottom structure of the tub fits into the opening of another tub. The bottom structure of each tub normally also comprises structural features for transport means such as forklifts to engage into. Management of the tubs in the cargo hold is then of importance, both with respect to tracing or knowing what is in each tub, but also how the tubs are arranged in the cargo hold of the fishing vessel. Managing tubs and stacks of tubs at sea, where constant movement of the vessel poses risk of the tubs falling over and also risk to the crew.

FR 2 621 567 discloses a system for handling containers in the cargo hold of a fishing vessel, where the containers are being arranged on either side of a longitutinal rolling path in the cargo hold, and where the system also comprises rails oriented transversely to the vessel. The system further comprises a carriage for transporting containers along the longitutinal rolling path and wherein a movable plate of the carriage is able to transport the containers along the rails oriented transversely to the vessel to transport the containes to each side of the rolling path.

SUMMARY OF THE INVENTION

The present invention relates to an apparatus, system and method for managing and securing cargo tubs in cargo holds such as storage/cooling/freezing facilities, a cargo hold of a vessel, such as a fishing vessel or food processing plants/factories. The apparatus, system and method are suitable for all kinds of cargo holds, but are specifically suitable for automatic cargo holds, unmanned cargo holds and cargo holds where space is limited. The cargo tubs are stackable tubs, where a portion of the bottom structure fits into the open upper surface of the tubs to lock the tubs at least partially together, such that a stack of tubs is tilted up to 17° the stack will not fall apart. The system of the present invention is fully automatic, where a stack of tubs is generated in the cargo hold by delivering one or more tubs into the cargo hold. When a stack is formed it is automatically transported as a stack using locks, physical guides or barriers, rails and mechanical moving systems such as jacks and motors. The system, method and devices of the present invention ensures that the stacks of tubs are secure at all time at sea as well as on shore during systematic loading of the cargo hold with a stack of tubs and also securing stacks of tubs and rows of stacks during transport at sea. When the vessel is in harbour, the tubs in the cargo hold are transported from the cargo hold and loaded off in an automatic manner using a moving transfer system in the cargo hold. The device, system and method of the present invention also ensure that the stacks can be securely moved in the cargo hold during offloading once in harbour. Generally, the cargo hold is positioned below the deck where tubs are loaded with items, such as processing deck, where fish is processed and transferred to cargo tubs. The tubs are then lowered to the cargo hold by a lifting mechanism. There, stacks are formed, and each stack is then transported to a storing location within the cargo hold.

The present invention provides a device, system and method for securing cargo tubs in a cargo hold of a vessel. The functional components of the present invention comprise means such as rails and wagons and pushing structures as transport means for securely transporting the stack of tubs, and jacks, locks and motors to operate the transport means in the cargo hold.

It is a big challenge to stack and transport tubs in a cargo hold of a ship at sea due to risk of a stack falling over spoiling the catch and being a severe security risk to the crew. Furthermore, the space within the cargo hold is valuable, so therefore it is also a challenge to use the cargo space as well as possible but still having the opportunity to transport tubs around the cargo hold for delivering of empty tubs to processing deck or for storing tubs in the cargo hold during fishing and transport in a safe and secure manner. Furthermore, the invention provides a solid and safe system and apparatus for securing the tubs in the cargo hold as the vessel is transporting either empty or full tubs in rough sea conditions. The present invention provides a solution to these problems with a fully automatic system and device for moving tubs in stacks around the cargo hold and providing means for delivering and receiving tubs to and from the cargo hold. Synchronised and automatic moving mechanism systematically provides empty tubs from a row of empty tubs and arranges full tubs in that row using the apparatus and the system of the present invention. Devices of the apparatus presented herein providing pulling and pushing functions on the stacks of tubs and with the aid of transport/storing lanes, lifts and a wagon can transport tubs and stacks of tubs vertically in and out of the cargo hold and in two perpendicular directions in the cargo hold without the risk of a stack of tubs breaking at any point. This is facilitated by rails, upper and lower (movable and fixed) locks, as well as a wagon and a pushing devices. The use of jacks, locks and motors to operate the pushing and pulling devices in addition to sensors, barriers and physical features of the tubs provide this fully automatic and safe system for arranging and transporting tubs in a cargo hold. In some embodiments of the present invention, the following features may be employed: a) use of pushing devices for pushing one or more stacks of tubs along the cargo lane, where the pushing device secures the stack of tubs from breaking when being transferred along the first direction of transport, b) by an arrangement of upper and lower longitudinal rails along each side of the every cargo lane, which secures the stacks of tubs from moving in a second direction of the cargo hold when being transferred along the first direction of transport or as they are being stored in a cargo lane, c) by means of a set of a movable transfer lock and a fixed lock adjacently positioned near one end of each cargo lane providing means for locking into the bottom structure of the bottom tub in a stack of tubs and pulling a stack into a wagon (movable lock) or securing a stack of tub (fixed lock) while an adjacent stack of tubs is pulled away from said stack of tubs in the first direction of the cargo lane, and d) a number of upper locks arranged at the in-feed and the out-feed end of a cargo lane within the longitudinal rails for engaging into the opening of the uppermost tub in a stack of tubs for securing tipping of a stack of tubs in the first direction as the support of a row of stacks of tubs is removed when a stack is being pulled into the wagon or when the donkey is being pulled back behind the lift shaft to allow formation of a new stack of tubs.

The present invention in useful in industry, not only for the purpose of enabling the currently existing equipment to operate at the ideal level of throughput, but also as a new standard of concentration control for which future devices can be designed to exploit.

It is an object of the present invention to overcome or ameliorate the aforementioned drawbacks of the prior art and to provide an improved and/or alternative and/or additional device for securing the transfer and storing of cargo tubs in a cargo hold.

Moreover, it is a preferred object of the present invention to provide an apparatus, a system and a method for securely transporting cargo tubs in and out of a cargo hold of a fishing vessel and to move tubs in stacks of tubs around the cargo hold in a fully automatic manner for providing empty tubs to a processing deck, to receive tubs filled with fish from a processing deck and to feed exit stacks of full tubs out of the cargo hold at shore. It is also a preferred object of the present invention to provide a method, a system and an apparatus having locks, barriers, pushing and pulling devices working in a synchronised manner to secure the stacks of tubs in a cargo hold at any time during storing or transport of the tubs.

The object(s) underlying the present invention is (are) particularly solved by the features defined in the independent claims. The dependent claims relate to preferred embodiments of the present invention, which further relate to the apparatus, system and method of the present invention. Further additional and/or alternative aspects are discussed below.

Thus, at least one of the preferred objects of the present invention is solved by an apparatus for securing stacks of cargo tubs in a cargo hold of a vessel. The apparatus comprises i) one or more cargo lanes for storing stacks of tubs in a cargo hold and for moving stacks of tubs along a first direction of the cargo hold, ii) one or more pushing device(s) for pushing one or more stacks of tubs along the cargo lane, and iii) upper and lower longitudinal rails positioned in the cargo hold along each side of the one or more cargo lanes, where the upper and lower longitudinal rails secure the stacks of tubs from moving in a second direction of the cargo hold.

In an embodiment of the present invention each tub in stack of tubs have an open upper surface and the bottom portion comprises structures to fit into the open upper surface for allowing stacking of two or more tubs in a stable stack, and wherein the bottom portion further comprises openings or other structural features for allowing pulling or lifting devices to engage into.

In an embodiment of the present invention the system or apparatus further comprises a movable transfer lock near one end of each cargo lane, said movable transfer lock transfers said stack of tubs along the first direction of the cargo hold out of the storing lane, In an embodiment of the present invention the system or apparatus further comprises a fixed lock adjacent to the movable transfer lock in each cargo lane, said fixed lock securing the next stack of tubs to be transferred out of the cargo lane.

In an embodiment of the present invention the system or apparatus further comprises a plurality of upper locks arranged between the upper longitudinal rails.

In an embodiment of the present invention the movable transfer locks and the fixed locks attach to a bottom structure of the lowest tub in a stack of tubs in a storing lane and the upper locks lock into the opening of the uppermost tubs in the stacks of tubs at the in-feed and the out-feed end of the storing lane to secure movement of a row of stack of tubs in a storing lane in the first direction of the cargo hold.

Another preferred object of the present invention is solved by an apparatus for securing stacks of cargo tubs in a cargo hold of a vessel. The apparatus comprises i) one or more cargo lanes for storing stacks of tubs in a cargo hold and for moving stacks of tubs along a first direction of the cargo hold, ii) one or more pushing device(s) for pushing one or more stacks of tubs along the cargo lane, iii) a movable transfer lock near one end of each cargo lane, said movable transfer lock transfers said stack of tubs along the first direction of the cargo hold out of the storing lane, and iv) a fixed lock adjacent to the movable transfer lock in each cargo lane, said fixed lock securing the next stack of tubs to be transferred out of the cargo lane. The apparatus further comprises v) upper and lower longitudinal rails positioned in the cargo hold along each side of the one or more cargo lanes for securing the stack of tubs from moving in a second direction of the cargo hold, and vi) a plurality of upper locks arranged between the upper longitudinal rails. Furthermore, the movable transfer locks and the fixed locks attach to a bottom structure of the lowest tub in a stack of tubs in each storing lane, the upper locks lock into the opening of the uppermost tubs in the stacks of tubs at the in-feed and the out-feed end of the storing lane to secure movement of a row of stack of tubs in a storing lane in the first direction of the cargo hold. Also, the upper and lower longitudinal rails secure the stacks of tubs from moving in a second direction of the cargo hold.

In an embodiment of the present invention the one or more storing lane for transporting comprises a row of rollers (for allowing advancing the stack of tubs along a first direction of the cargo hold.

In an embodiment of the present invention the one or more cargo lanes for storing and transporting stacks of tubs comprises one or more conveyors along each cargo lane.

In an embodiment of the present invention the movable transfer lock and the fixed lock comprise lock-bars, which eject outwardly and perpendicularly from the transport direction of the cargo lane into openings or recesses in the bottom tub of the stack of tubs.

In an embodiment of the present invention the apparatus further comprises one or more wagons for transporting one stack of tubs along a second direction of the cargo hold.

In an embodiment of the present invention the wagon moves along a second transport lane.

In an embodiment of the present invention the upper locks comprise one or more locking or latch members for locking into the opening of the uppermost tub in the stack of tubs.

In an embodiment of the present invention the upper locks are positioned at the in-feed end and the out-feed end of the storing lane as well as in the wagon.

In an embodiment of the present invention the wagon comprises physical barriers for preventing tilting or sliding of the stack of tubs in the wagon in either the first or the second direction of the cargo hold.

Another preferred object of the present invention is solved by a system for securing stacks of cargo tubs in a cargo hold of a vessel. The system comprises i) one or more cargo lanes for storing stacks of tubs in a cargo hold and for moving stacks of tubs along a first direction of the cargo hold, ii) one or more pushing device(s) for pushing one or more stacks of tubs along each cargo lane, and iii) upper and lower longitudinal rails positioned in the cargo hold along each side of the one or more cargo lanes, where the upper and lower longitudinal rails secure the stacks of tubs from moving in a second direction of the cargo hold.

In an embodiment of the present invention the system further comprises iv) a movable transfer lock near one end of each cargo lane, said movable transfer lock transfers said stack of tubs along the first direction of the cargo hold out of the storing lane, v) a fixed lock adjacent to the movable transfer lock in each cargo lane, said fixed lock securing the next stack of tubs to be transferred out of the cargo lane, and vi) a plurality of upper locks arranged within the upper longitudinal rails. Furthermore, in each storing lane the movable transfer locks and the fixed locks attach to a bottom structure of the lowest tub in a stack of tubs in a storing lane, the upper locks lock into the opening of the uppermost tubs in the stacks of tubs at the in-feed and the out-feed end of the storing lane to secure movement of a row of stack of tubs in a storing lane in the first direction of the cargo hold.

In an embodiment of the present invention the locking of the upper locks and the fixed and the movable transfer locks is synchronized with the movement of the pushing devices and the movable transfer lock as; a) the pushing device pushes a stack of tubs along the storing lane from the in-feed end towards the out-feed end during filling the cargo hold of stacks of tubs, and b) the movable transfer lock transports the stack of tubs at the out-feed end into the wagon for transport in the second direction during emptying of a storing lane or transfer of stack of tubs between parallel storing lanes.

In an embodiment of the present invention the movable lock and fixed lock push lock-members perpendicularly from the transport direction of the cargo lane into openings in the bottom structure of the lowest tub in the stack of tub.

Another preferred object of the present invention is solved by a system for securing stacks of cargo tubs in a cargo hold of a vessel. The system comprises i) one or more cargo lanes for storing stacks of tubs in a cargo hold and for moving stacks of tubs along a first direction of the cargo hold, ii) one or more pushing device(s) for pushing one or more stacks of tubs along the cargo lane, iii) a movable transfer lock near one end of each cargo lane, said movable transfer lock transfers said stack of tubs along the first direction of the cargo hold out of the storing lane, and iv) a fixed lock adjacent to the movable transfer lock in each cargo lane, said fixed lock securing the next stack of tubs to be transferred out of the cargo lane. The system further comprises v) upper and lower longitudinal rails positioned in the cargo hold along each side of the one or more cargo lanes for securing the stack of tubs from moving in a second direction of the cargo hold, and vi) a plurality of upper locks arranged between the upper longitudinal rails. Furthermore, the movable transfer locks and the fixed locks attach to a bottom structure of the lowest tub in a stack of tubs in each storing lane, the upper locks lock into the opening of the uppermost tubs in the stacks of tubs at the in-feed and the out-feed end of the storing lane to secure movement of a row of stack of tubs in a storing lane in the first direction of the cargo hold. Also, the upper and lower longitudinal rails secure the stacks of tubs from moving in a second direction of the cargo hold.

In an embodiment of the present invention the locking of the upper locks and the fixed and the movable transfer locks is synchronized with the movement of the pushing devices and the movable transfer lock as: a) the pushing device pushes a stack of tubs along the storing lane from the in-feed end towards the out-feed end during filling the cargo hold of stacks of tubs, and b) the movable transfer lock transports the stack of tubs at the out-feed end into the wagon for transport in the second direction during emptying of a storing lane or transfer of stack of tubs between parallel storing lanes.

Another preferred objects of the present invention is solved by a method for securing stacks of cargo tubs in a cargo hold of a vessel, the method comprises the steps of: a) moving and storing stacks of tubs in a cargo hold along a first direction of the cargo hold using one or more transporting and cargo lanes, b) securing the movement or storing the stack of tubs along the first direction of the cargo hold by means of: i) one or more pushing device(s) for pushing one or more stacks of tubs along the cargo lane, ii) one or more movable locks near one end of each cargo lane, said movable lock transfers said stack of tubs along the first direction of the cargo hold out of the storing lane, iii) a fixed lock adjacent to the movable transfer lock in each cargo lane, said fixed lock securing the next stack of tubs to be transferred out of the cargo lane, iv) a plurality of first upper lock arranged at the out-feed end within the longitudinal rails, and v) at least on second upper lock arranged at the in-feed end within the longitudinal rails, and c) securing the movement or storing the stack of tubs along the second direction of the cargo hold by means of: vi) upper longitudinal rails positioned in the upper part of the cargo hold along each side of the one or more cargo lanes for securing the stack of tubs from moving in a second direction of the cargo hold, and vii) lower longitudinal rails positioned in the lower part of the cargo hold along each side of the one or more cargo lanes for securing the stack of tubs from moving in a second direction of the cargo hold. In each storing lane, the fixed and the movable transfer locks attaches to a bottom structure of the lowest tub in a stack of tubs in a storing lane, where the first and second upper locks lock into the opening of the uppermost tubs in the stacks of tubs at the in-feed and the out-feed end of the storing lane to secure movement of a stacks of tubs in a storing lane during transport of stacks of tubs in the first direction of the cargo hold.

Another preferred object of the present invention is solved by an apparatus for securing stacks of cargo tubs in a cargo hold The apparatus comprises i) one or more cargo lanes for storing stacks of tubs in a cargo hold and for moving stacks of tubs along a first direction of the cargo hold, ii) one or more pushing device(s) for pushing one or more stacks of cargo tubs along the cargo lane, iii) a movable transfer lock near one end of each cargo lane, said movable transfer lock transfers said stack of tubs along the first direction of the cargo hold out of the storing lane, and iv) a fixed lock adjacent to the movable transfer lock in each cargo lane, said fixed lock securing the next stack of tubs to be transferred out of the cargo lane, where the movable transfer locks and the fixed locks are arranged in the bottom part of each cargo lane and where the movable transfer locks and the fixed locks attach to a bottom structure of the lowest cargo tub in a stack of cargo tubs in a storing lane to secure and move said stacks of cargo tubs. Such an apparatus allows save transfer of a stack of tubs, either in a warehouse kind of cargo hold or a cargo hold of a vessel, where the fixed lock secures the stack next to a stack to be moved and the movable lock transfers a whole stack along a cargo lane, such as rails. To further stabilise and secure the movement of a stack of tub, especially in a cargo hold of a vessel, optionally a set of upper locks are arranged above or in the upper part of the cargo laine, which lock into the opening of the uppermost tub in the stacks of cargo tubs. The upper locks are synchronised with the fixed lock and the movable lock in such a manner that the upper locks operating with the fixed lock keep a stack of tubs fixed at the top and bottom of a stack while the upper locks operating with the movable lock move in a synchronised manner with the movable lock along the storing lane to secure movement of a row of stack of tubs in a storing lane at the top and bottom of a stack.

In an embodiment of the present invention the lock slides under the stack of tubs and pushes lock-members perpendicularly from the transport direction of the storing lane into openings in the bottom structure of the lowest tub in the stack of tub.

In an embodiment of the present invention the method further comprises one or more wagons for transporting one stack of tubs along a second direction of the cargo hold, wherein the wagon comprises physical barriers for preventing tilting or sliding of the stack of tubs in the wagon in either the first or the second direction of the cargo hold.

In an embodiment of the present invention the tubs have an open upper surface and the bottom portion comprises structures to fit into the open upper surface and wherein the bottom portion further comprises openings in at least two opposite sides.

In an embodiment of the present invention the one or more pushing devices for pushing one or more stacks of tubs along the storing lane comprises a pushing plate for applying pressure onto two or more tubs in a stack.

In an embodiment of the present invention the wherein the one or more pushing devices for pushing one or more stacks of tubs along the storing lane is operated by hydraulic jacks.

In an embodiment of the present invention movements of the donkey, the movable lock and the wagon, as well as the engaging and disengaging of the fixed lock, the movable lock and the upper locks are synchronized by an industrial computer and optionally sensors in the cargo hold.

In an embodiment of the present invention upper and lower longitudinal rails are positioned in the cargo hold along each side of the one or more cargo lanes.

In an embodiment of the present invention the cargo hold is a cargo hold of a fishing vessel, where the cargo hold is full of empty cargo tubs at the beginning of a tour. Tubs are transported out of the cargo hold up to the processing or pre-processing deck through one chosen cargo lane. This lane receives new stacks of tubs from other cargo lanes via the out-feed via a transport lane perpendicular to the cargo lanes, being positioned at the out feed end of all the cargo lanes and where a wagon can receive a stack of tubs from one cargo lane and transport said stack to the cargo lane feeding the processing deck. As tubs are continuously being filled with catch, new tubs are being lowered into the cargo hold by the lift for each cargo lane and therefore forming a new stack at the in-feed end of the lane as an empty stack is evacuated form the out-feed end of the lane and into the wagon. Therefore, the process of securely replacing a stack of empty tubs with full tubs is as follows:

a) Pushing means, such as a donkey, pushes a stacks of tubs towards end of a cargo lane leaving the lift shaft empty and pushing one stack of tubs into the wagon, where the pushing bar and the side rails provide support to the stacks during the transfer.
b) The donkey is pulled back and the stack of tubs is fixed in it's position by an upper lock, which locks into the opening of the upper most tub in the stack for stabilizing the stack.
c) New tubs are lowered down into a cargo hold to form a new stack of tubs.
d) Steps a) to c) are repeated until all the empty tubs in the cargo lane have been pushed out and the cargo lane has been filled with full tubs in stacks.
e) When only the cargo lane feeding tubs out of the cargo hold and up to the pre-processing deck (the last lane) is left to fill, tubs filled with catch are transported by the wagon out of one or more of the other cargo lanes and into the last lane to fill the cargo hold with full tubs and the upper and lower longitudinal side rails provide support to the stacks of tubs in the direction perpendicular to the direction of the transport lanes.

The process of loading the last two stacks of tubs into the wagon (where the donkey is not used to push the stacks, is as follows:

a) The movable lock engages into the bottom structure of the bottom tub in the stack next to the wagon and pulls that stack into wagon. As soon as that process is initiated, the upper locks are released. In the meantime, the fixed lock is engaged into the aft opening of the bottom structure of the bottom tub in the second last stack in the cargo lane with upper locks engaged into the opening of the upper most tub in the stack.
b) The movable lock returns to engage into the front opening of the bottom structure of the bottom tub in the second last stack in the cargo lane.
c) The fixed lock is disengaged, and the upper locks are released.
d) The movable lock pulls the now last stack into the wagon and then returns to a position nest to the donkey. In steps a)-d) synchronized function of upper locks, the fixed lock and the movable locks provides secure transfer of stacks of tubs from the lane and into the wagon, where an upper lock and physical barriers provide support for the stack of tubs as the wagon transports the stack along the second direction.

This process is also shown in FIG. 6. In order for secure movement of stacks of tubs along the cargo lanes and the transfer lane (in the wagon), the donkey, the fixed lock, the movable lock and the upper lock all have to be synchronized in their moving, engaging and disengaging.

Another preferred object of the present invention is solved by a system for securing and moving stacks of cargo tubs in a cargo hold. The system comprises; i) one or more cargo lanes for storing stacks of tubs in a cargo hold and for moving stacks of tubs along a first direction of the cargo hold, ii) a movable transfer lock near one end of each cargo lane, said movable transfer lock transfers said stack of tubs along the first direction of the cargo hold out of the storing lane, iii) a fixed lock adjacent to the movable transfer lock in each cargo lane, said fixed lock securing the next stack of tubs to be transferred out of the cargo lane, where the movable transfer locks and the fixed locks are arranged in the bottom part of each cargo lane and where the movable transfer locks and the fixed locks attach to a bottom structure of the lowest tub in a stack of tubs in a storing lane.

In In an embodiment of the present invention a plurality of upper locks arranged between the upper longitudinal rails in the upper part of each cargo lane, wherein the upper locks lock into the opening of the uppermost tubs in the stacks of tubs.

In an embodiment of the present invention the upper locks are synchronised with the fixed lock and the movable lock such that a set of upper locks operating with the fixed lock keep a stack of tubs fixed at the top and bottom of a stack while the upper locks operating with the movable lock move in a synchronised manner with the movable lock along the storing lane to secure movement of a row of stack of tubs in a storing lane at the top and bottom of a stack.

In the present context the terms "tubs", "stackable tubs" and "cargo tubs" all relate to tubs, where a portion of the bottom structure fits into the open upper surface of the tubs to lock the tubs at least partially together. Such tubs are well known in the art and have been used for years in the fishing industry to store and transport fish from fishing grounds to factories or markets. A stack of the stackable tubs of the present invention cannot break in a transport lane of the invention with upper and lower longitudinal rail when the vessel is tilted from side to side during sailing. This is due to how the bottom structure fits into the open upper surface of the tubs to form a stable stack.

In the present context the terms "cargo lane" or "storage lane", "transport lane" or any combination thereof are used for rows for advancing and storing tubs in a cargo hold. The lanes have a bottom structure for tubs or stack of tubs to be pushed or pulled on to either enter, store in or empty tubs or stacks of tubs from the lanes. These rows or lanes have structures, locks, pulling and pushing means to advance and secure tubs or stacks of tubs in the lanes.

In the present context the term "cargo hold" refers to a space in building or deck or a part of a deck on board a vessel, where cargo is transported into, stored and transported out of again.

In the present context the terms "Donkey" and "pushing means" both refer to a movable device arranged at one end of a cargo/transfer lane for pushing one or more stack(s) of tubs along the cargo/transfer lane. The pushing device is operated by an actuator such as a motor or a jack.

In the present context the term "wagon" refers to a movable structure which operates on a transfer lane or row and holds a stack of tubs securely in it. Physical barriers such as a frame and locks are a part of the wagon to secure a stack of tubs in the wagon during the transfer of a stack of tubs in the cargo hold.

In the present context the terms "first direction" or "X-direction" relate to the direction of the cargo lanes. In the embodiments shown in some of the drawings the first direction is along the length of the fishing vessel.

In the present context the terms "second direction" or "Y-direction" relate to the direction of the transfer lane of the wagon. In the embodiments shown in some of the drawings the first direction is between the starboard and the port of the fishing vessel.

In the present context wherein the movable lock and the fixed lock arranged at the out-feed end of a cargo/transport lane are used to transport the last stacks of tubs from the out-feed end of a cargo/transport lane and into the wagon in the absence or non-use of the pushing device (donkey).

BRIEF DESCRIPTION OF DRAWINGS

The present invention will be further described with reference to the drawings using reference numbers in the drawings to identify the individual components of the invention.

DETAILED DESCRIPTION OF THE PRESENT INVENTION

In the following, exemplary embodiments of the invention will be described, referring to the figures. These examples are provided to provide further understanding of the invention, without limiting its scope.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

Figure 1:
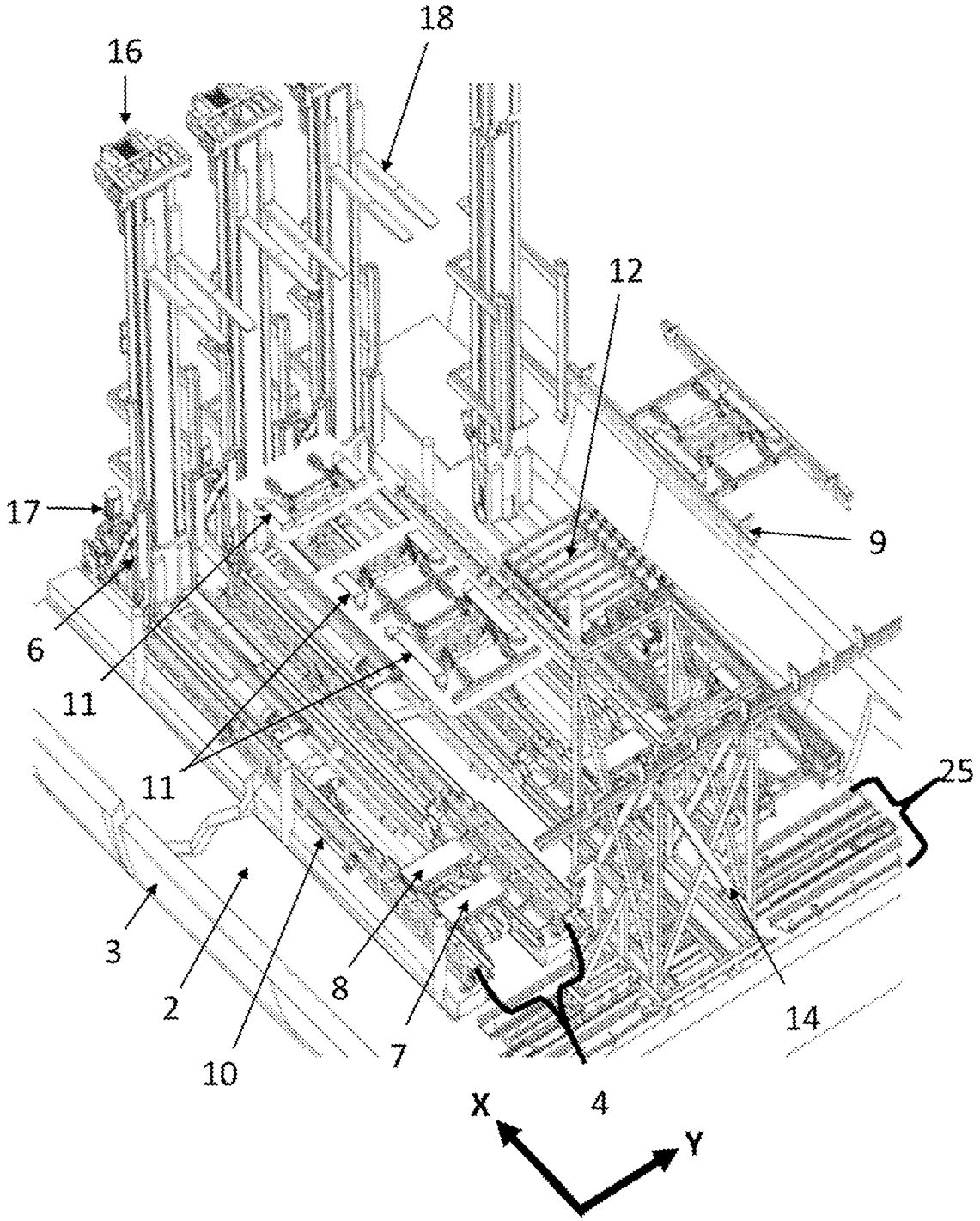
FIG. 1 shows the individual components of the in-feeding device of the present invention.

FIG. 1 shows a perspective view of the apparatus and system of the present invention seen from the side and above. The system has for transport and storing lanes for tubs in stacks and lifts to transport tubs to and from a processing deck or in and out of the cargo hold. The setup shown in FIG. 1 has four transport and storage lanes with lifts where one top one lane is connected to a lift for transporting tubs in and out of the cargo hold and the other three lifts transport tubs to and from a processing deck. In such a set up one lane is used to transport empty tubs through an opening above the lift into the cargo hold, such as the middle lane for example. When a stack of tub is transported from any of the other lanes into the middle lane, a stack is pushed into the wagon and the wagon transports the stack of tubs in a direction perpendicular to the transport direction of the transport and storing lanes to the middle lane for advancement towards the lift and the opening into the processing deck. When tubs are loaded into a stack on each of the lifts from the processing deck, the full stack is then transported along the transport and storing lane. When the tubs are transported out of the cargo hold, pushing means (donkey) for each of the lanes not connected to the lift for transporting tubs in and out of the cargo hold pushes one stack at the time into the wagon and the wagon transports each stack to the lane connected to the lift for transporting tubs in and out of the cargo hold for off-loading. FIG. 1 shows a cargo hold 2 of a vessel 3 four lifts 16 for delivering tubs into the cargo hold 2. The figure shows the cargo lanes 4 for storing stacks of tubs in a cargo hold 2 and for transporting stacks of tubs along a first direction (x) of the cargo hold 2 and a wagon 14 for transporting the stack of tubs along a second direction (y) of the cargo hold 2 on a transport lane 25 arranged in the second direction in the cargo hold 2. The transport and storage lanes have means of allowing stacks of tubs to travel or advance along the lanes, such as rollers 12. As most of the lifts transport full tubs into the cargo hold the end of the storing and cargo lane 4 adjacent to the lifts is referred to as the in-feed end and the end of the cargo lane 4 adjacent to the wagon 14 is defined as the out-feed end, although this is in fact opposite for the lane feeding empty tubs up to the processing deck and for the lane feeding tubs out of the cargo hold by lift 16. A pushing device 6 (donkey) is arranged by each of the lifts 16 for pushing the stacks of tubs along the cargo lane 4. A set of locks are arranged near the outfeed end of each cargo lane 4 for managing the transport of the stacks of tubs (one at a time) into the wagon 14 for transport of a stack of tubs into another cargo lane 4. The locks are divided into a fixed lock 8 and a movable transporting lock or pulling device 7 for pulling the stack of tubs along the one or more cargo lane 4 into the wagon 14. The system has a plurality of actuators 17 for moving the lifts 16, the wagon 14, the pushing devices 6 and the pulling devices 7 in the cargo hold. The actuators 17 can be motors or jacks, such as hydraulic jacks. The drawing also a set of upper locks 11 at the in-feed end and the outfeed end. The in-feed end upper locks 11 hold the stack of tubs as a new stack of tubs is being lowered by a lift 16 into the cargo hold 2. The outfeed end upper locks 11 hold the second last stack of tubs at the outfeed end as the last stack of tubs at the outfeed end is being loaded into the wagon 14. As shown in the drawing the lifts have carrying means such as forks 18 for loading or unloading a stack of tubs into or out of the cargo hold. The drawing further shows upper 9 and lower 10 longitudinal rails positioned along the storing lane for securing the stack of tubs from moving in a second direction of the cargo hold.

Figure 2:
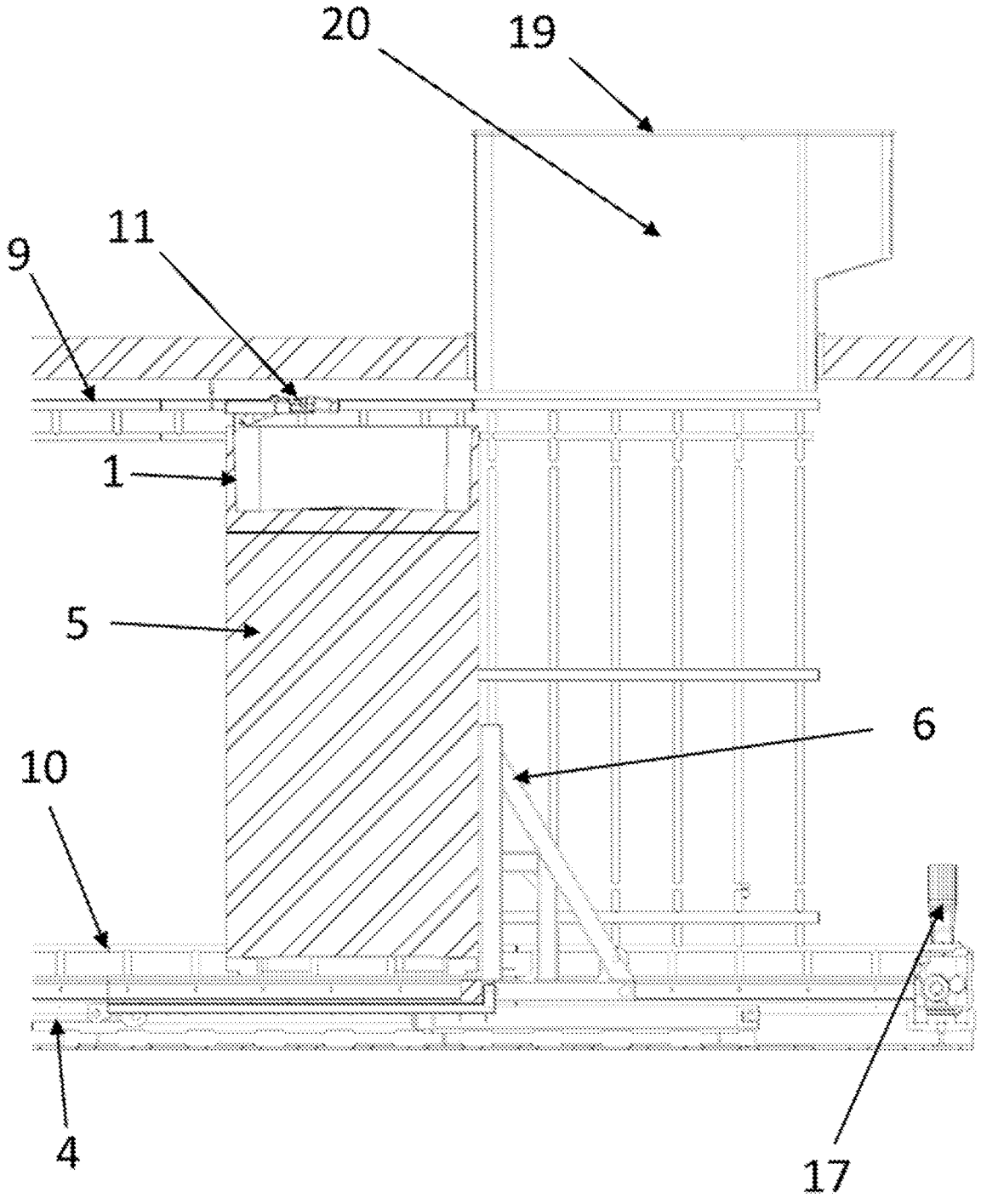
FIG. 2 shows a side view (A) of the grading apparatus and thein-feeding device.

FIG. 2 shows a side-view of the in-feed end of a storing/transport lane 4 for stacks of tubs 5. The drawing shows an opening 19 into the cargo-hold 2 for loading a stack of tubs 5 into the cargo-hold 2. The pushing device 6 is arranged below the opening 19 for pushing the stacks of tubs 5 along the cargo lane 4. In this drawing the pushing device 6 has pushed the stack of tubs 5 away from the stacking position underneath the lift shaft 20 below the opening 19. The drawing shows an actuator 17 for giving power to the pushing device 6. An upper lock 11 at the in-feed end is also shown for holding a stack of tubs in place as the pushing means backs up to fetch a new stack of tubs. The drawing also shows upper longitudinal rails 9 positioned in the upper part of the cargo hold 2 and lower longitudinal rails 10 positioned in the lower part of the cargo hold 2 along the storing lane for securing the stack of tubs from moving in a second direction of the cargo hold.

Figure 3:
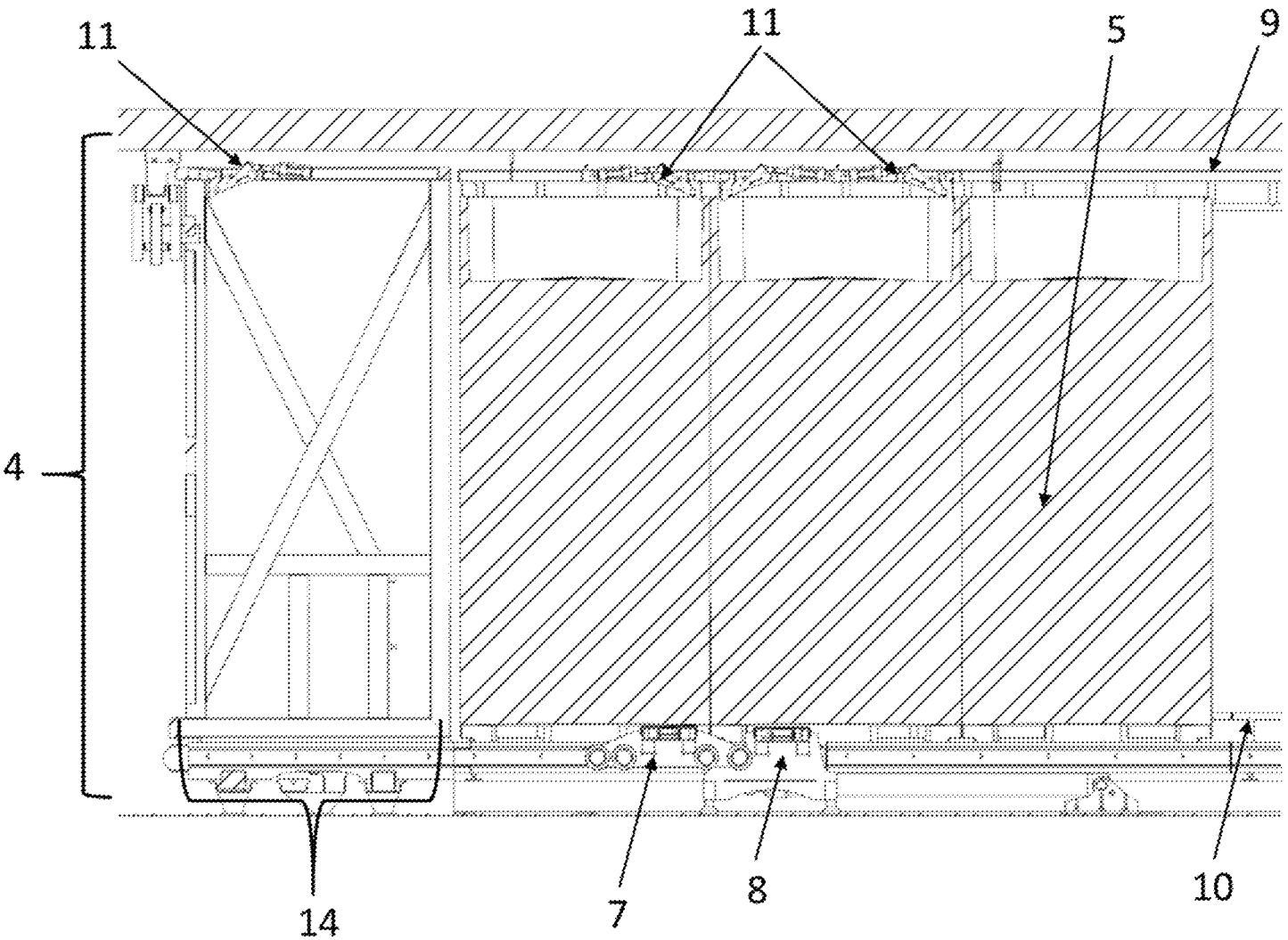
FIG. 3 shows a perspective drawing of the in-feed device of the present invention.

FIG. 3 shows a side-view of the out-feed end of a cargo lane 4 for stacks of tubs 5. The drawing shows the wagon 14 for transferring a stack of tubs 5 in a direction perpendicular to the direction of the transport direction of the cargo lanes 4. A set of locks are arranged on the cargo lane 4 for holding one stack of tubs in a fixed position and transporting another stack of tubs into the wagon 14, said locks are a fixed lock 8, and a movable lock 7. The movable lock can lock into a bottom structure of a stack of tubs and pull that stack into the wagon 14. A pair of upper locks 11 at the outfeed end also assist with stabilizing the stacks of tubs as the last stack of tubs 5 is being transferred into the wagon 14. The drawing also shows an upper lock in the wagon for stabilizing or securing a stack of tubs in the first direction in the wagon and physical barriers for securing the stack of tubs in the second direction during transport in the wagon 14. The drawing shows the upper 9 and lower 10 longitudinal rails positioned along the cargo lane towards the wagon, for securing the stack of tubs from moving in a second direction of the cargo hold. The drawing further shows an upper lock 11 in the wagon 14 for stabilizing the stack of tubs as the wagon transports said stack of tubs along the second direction of transportation.

Figure 4:
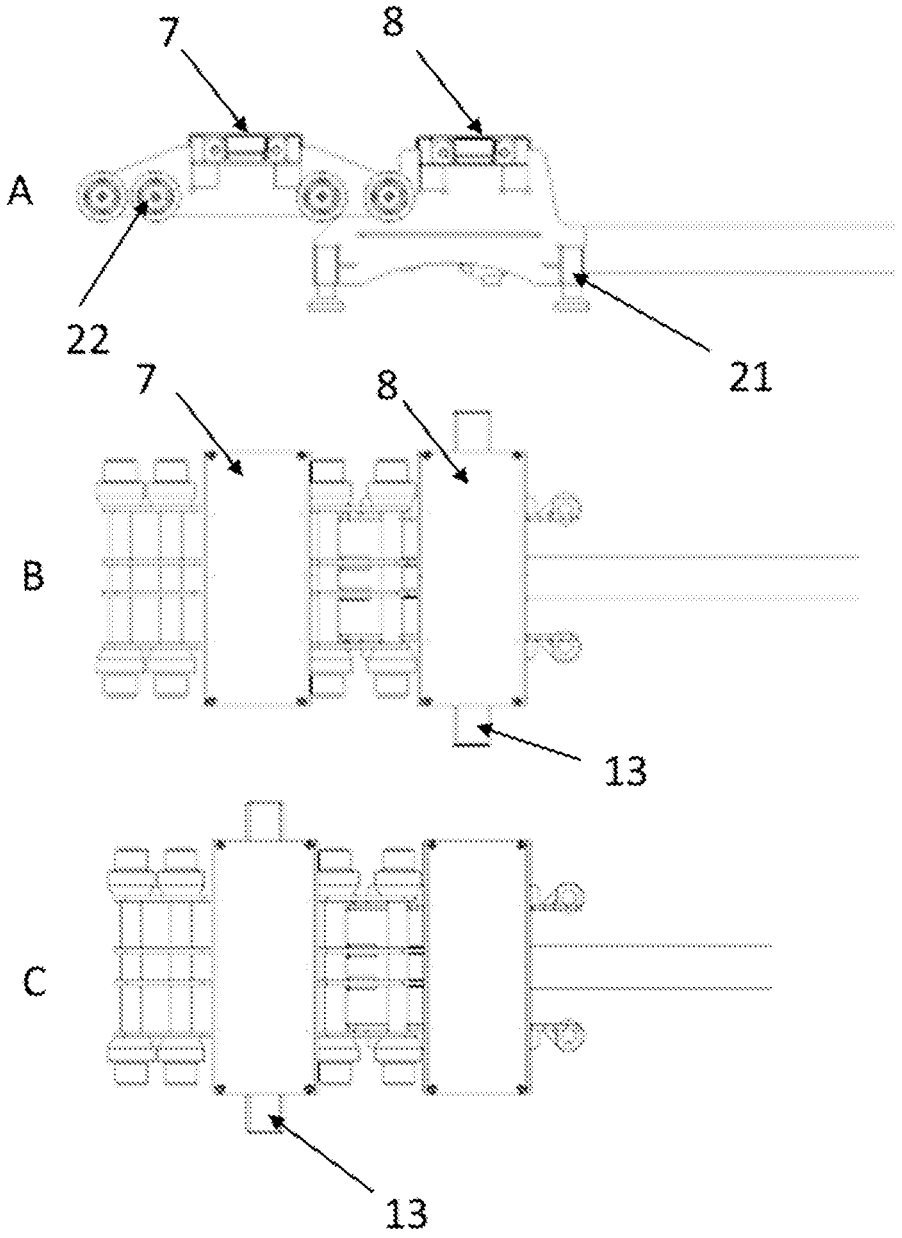
FIG. 4 shows a top view of the in-feed device of the present invention.

FIG. 4 shows the movable lock 7 and the fixed lock 8 in an adjacent position. FIG. 4A is a side view showing the fixed lock being fixed 21 to the floor whereas the movable lock is on wheel/rollers 22. FIGS. 4B and C are a top view of the fixed lock 8 and the movable lock 7 in the same adjacent position. The drawing shows how the fixed lock is engaged in FIG. 4B as the lock-bars 13 are ejected out whereas the moving lock is not. In FIG. 4C the fixed lock is not disengaged, but now the moving lock is engaged. As the locks 7,8 are positioned underneath the tubs and the tubs have recesses or openings in their bottom structure, the locks engage into the bottom structure by "shooting out" lock bars 13 or panels which engage into the apertures or openings in the bottom structure of the bottom tub in a stack of tubs.

Figure 5:
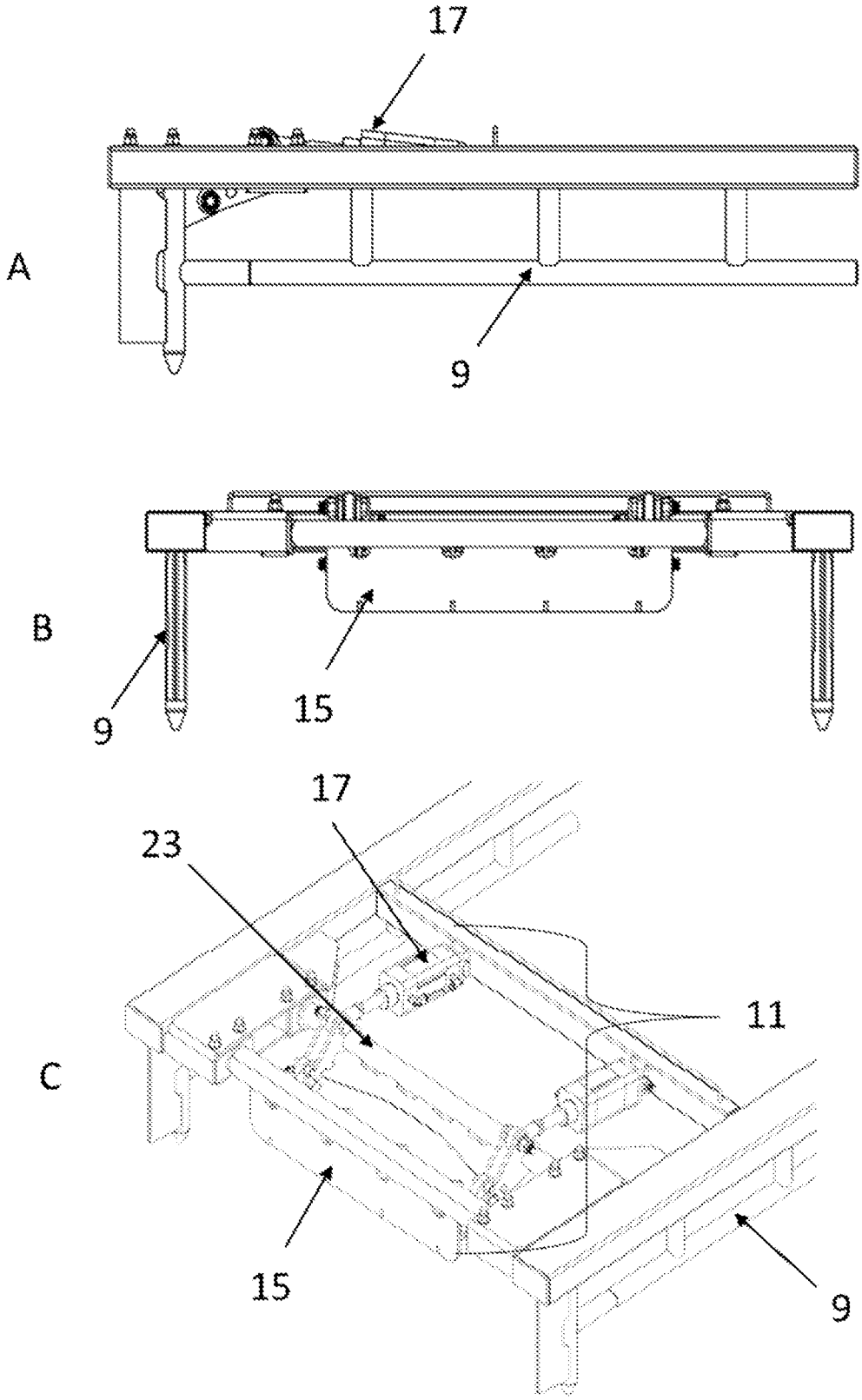
FIG. 5 shows the upper locks of the invention.

FIG. 5 shows the upper locks 11 of the present invention. FIG. 5A is a side view of an upper lock 11, which is positioned between the upper longitudinal rails 9 of each cargo lane. The limited view of the upper lock in FIG. 5A shows an actuator (a jack) 17 for engaging or disengaging the locking member of the upper lock. In FIG. 5B a front view of an upper lock is shown between the upper longitudinal rails 9. The limited view of the upper lock in FIG. 5B shows the front end of the upper longitudinal rails 9 and the latch member 15 of the upper lock being the locking member of this device. FIG. 5C is a perspective view of an upper lock seen from above. The drawing shows the actuator 17 secured on bars between the upper longitudinal rails 9 and extending over a pivoting mechanism 23 to the latch member 15 to engage or disengage the locking function of the upper lock 11.

Figure 6:
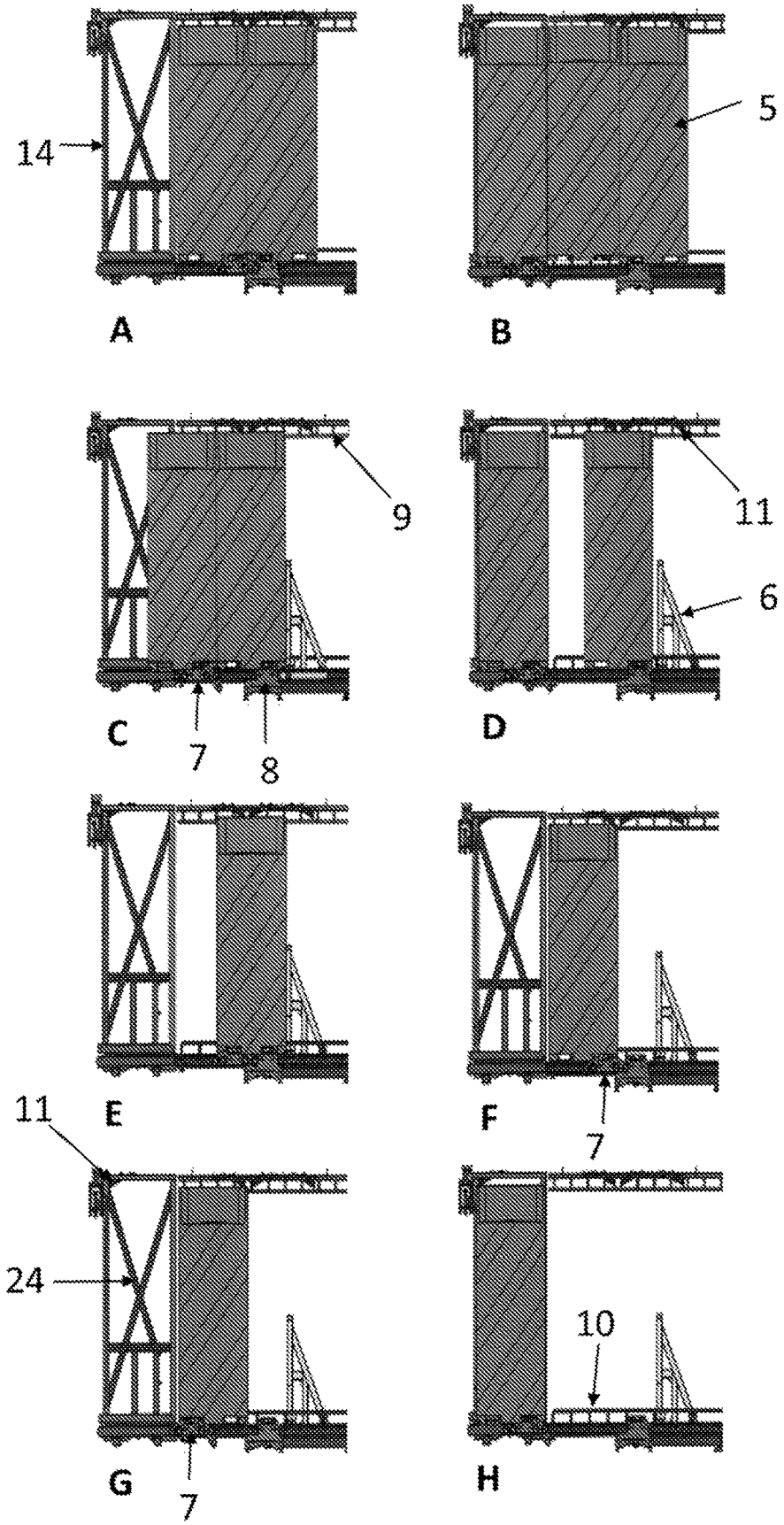
FIG. 6 outlines the transfer of stacks of tubs one by one into a wagon until the transport/storing lane is empty.

FIG. 6 shows how pushing devices, locks and longitudinal rails are used together to securely transport stacks of tubs along the cargo lanes in the cargo hold. The figure shows how stacks of tubs are transferred one by one into the wagon until the cargo lane is empty providing support to the stack in every step. The pushing device, the fixed lock and the movable lock are synchronised together with the upper locks to move stacks of tubs into the wagon. FIG. 6A shows an empty wagon 14 and two adjacent stacks of tubs 5 next to the wagon. Each bottom tub in a stack has two openings on each side in the bottom surface of the tub for the locks to lock into. The movable lock 7 is locked into the aft opening (further away from the wagon) of the tub next to the wagon and the fixed lock 8 is locked into the front opening of the tub adjacent to the tub next to the wagon. In FIG. 6B the stack of tubs has been pulled into the wagon 14 and two adjacent stacks of tubs are shown waiting in line to be transported into the wagon. The figure also shows that the movable lock 7 is still locked into the bottom portion of the bottom tub showing that the bottom lock can pull a stack of tubs all the way into the wagon. FIGS. 6C-H show how the remaining two stacks of tubs are transported out of the cargo lane. The donkey (pushing device) 6 pushes the last two stacks of tubs onwards such that the last stack of tubs is half-way into the wagon and provides support from behind in the x-direction whereas the upper and lower longitudinal rails provide support in the Y-direction (FIG. 6C). The movable lock is locked into the aft opening of the tub half-way into the wagon and pulls this stack of tubs into the wagon, whereas the fixed lock is locked into the front opening of the tub adjacent to the tub being transferred into the wagon and that same stack of tubs is secured by an upper lock 11 as well (FIG. 6D). In FIG. 6E the wagon has been emptied and is ready for the last stack of tubs in the cargo lane, which is secured by the donkey, the fixed and movable lock as well as the upper locks. The movable lock has returned to pick up the last stack of tubs and the donkey has reached the end position in front of the fixed lock. The movable lock locks into the front opening of the bottom tub and pulls the last stack of tubs in a position next/adjacent to the wagon. In FIG. 6F the moveable lock moves to lock into the aft opening of the bottom tub of the last stack of tubs in order to pull the stack into the wagon. FIG. 6G shows and empty wagon with an upper lock 11 and physical barriers 24 to secure a stack of tubs during transport in the wagon. In FIG. 6H the movable lock has pulled the stack into the wagon 14.

As used herein, including in the claims, singular forms of terms are to be construed as also including the plural form and vice versa, unless the context indicates otherwise.

Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. An apparatus for securing stacks of cargo tubs 1 in a cargo hold 2 of a vessel 3 during transfer and storing, the apparatus comprising:

one or more cargo lanes 4 for storing stacks of tubs 5 in a cargo hold 2 and for moving stacks of tubs 5 along a first direction of the cargo hold 2, one or more pushing device(s) 6 for pushing one or more stacks of tubs along the cargo lane 4, a movable transfer lock 7 near one end of each of the one or more cargo lanes 4 configured to transfer the stacks of tubs along the first direction of the cargo hold to the end of or out of the respective one of the one or more cargo lanes, upper 9 and lower 10 longitudinal rails positioned in the cargo hold 2 along each side of the one or more cargo lanes 4, and wherein the upper 9 and lower 10 longitudinal rails secure the stacks of tubs from moving in a second direction of the cargo hold.

2. The apparatus according to claim 1, wherein each tub in stack of the tubs have an open upper surface and the bottom portion comprises structures to fit into the open upper surface for allowing stacking of two or more tubs in a stable stack, and wherein the bottom portion further comprises openings or other structural features for allowing pulling or lifting devices to engage into.

3. The apparatus according to claim 1, further comprising a fixed lock 8 adjacent to the movable transfer lock 7 in each cargo lane 4, said fixed lock 8 securing the next stack of tubs 5 to be transferred to the end of or out of the cargo lane 4.

4. The apparatus according to claim 1, further comprising a plurality of upper locks 11 arranged between the upper longitudinal rails 9,10.

5. The apparatus according to claim 4, wherein the upper locks 11 are positioned at the in-feed end and the out-feed end of the cargo lane 4 as well as in a wagon 14.

6. The apparatus according to claim 3, wherein the movable transfer locks 7 and the fixed locks 8 attach to a bottom structure of the lowest tub 1 in a stack of tubs 5 in a cargo lane, the upper locks 11 lock into the opening of the uppermost tubs in the stacks of tubs at the in-feed and the out-feed end of the cargo lane 4 to secure movement of a row of stack of tubs 5 in a cargo lane 4 in the first direction of the cargo hold 2.

7. The apparatus according to claim 3, wherein the movable transfer lock 7 and the fixed lock 8 comprise lock-bars 13, which eject outwardly and perpendicularly from the transport direction of the cargo lane into openings or recesses in the bottom tub of the stack of tubs.

8. The apparatus according to claim 4, wherein the upper locks 11 comprise one or more locking or latch members 15 for locking into the opening of the uppermost tub in the stack of tubs.

9. The apparatus according to claim 1, further comprising one or more wagons 14 for transporting one stack of tubs along a second direction of the cargo hold.

10. The apparatus according to claim 9, wherein the wagon comprises physical barriers 24 for preventing tilting or sliding of the stack of tubs in the wagon 14 in either the first or the second direction of the cargo hold.

11. The apparatus according to claim 1, wherein the one or more cargo lane comprises a row of rollers 12.

12. A system for securing stacks of cargo tubs in a cargo hold of a vessel during transfer and storing, the system comprising:

stacks of tubs, each tub in the stacks of tubs having an open upper surface and a bottom portion comprising structures to fit into the open upper surface of an upper one of a tub of the stacks of tubs to allow stacking of two or more tubs in a stable stack, the bottom portion further comprising openings or other structural members to allow pulling or lifting devices to engage thereinto;

one or more cargo lanes 4 for storing stacks of tubs 5 in a cargo hold 2 and for moving stacks of tubs 5 along a first direction of the cargo hold 2, one or more pushing device(s) 6 for pushing one or more stacks of tubs along each cargo lane 4, a movable transfer lock 7 near one end of each cargo lane 4, said movable transfer lock transfers said stack of tubs along the first direction of the cargo hold out of the cargo lane, upper 9 and lower 10 longitudinal rails positioned in the cargo hold 2 along each side of the one or more cargo lanes 4, and wherein the upper 9 and lower 10 longitudinal rails secure the stacks of tubs from moving in a second direction of the cargo hold.

13. The system according to claim 12, further comprising:

a fixed lock 8 adjacent to the movable transfer lock 7 in each cargo lane 4, said fixed lock 8 securing the next stack of tubs 5 to be transferred out of the cargo lane 4, and a plurality of upper locks 11 arranged within the upper longitudinal rails, wherein in each cargo lane the movable transfer locks 7 and the fixed locks 8 attach to a bottom structure of the lowest tub in a stack of tubs in a storing lane, the upper locks 11 lock into the opening of the uppermost tubs in the stacks of tubs at the in-feed and the out-feed end of the cargo lane to secure movement of a row of stack of tubs in a cargo lane in the first direction of the cargo hold.

14. The system according to claim 12, further comprising one or more wagons for transporting the stack of tubs along a second direction of the cargo hold.

15. The system according to claim 12, wherein the locking of the upper locks and the fixed and the movable transfer locks is synchronized with the movement of the pushing devices and the movable transfer lock as:

i) the pushing device pushes a stack of tubs along the cargo lane from the in-feed end towards the out-feed end during filling the cargo hold of stacks of tubs, and ii) the movable transfer lock transports the stack of tubs at the out-feed end into the wagon for transport in the second direction during emptying of a cargo lane or transfer of stack of tubs between parallel cargo lanes.

16. The system according to claim 13, wherein the movable lock and fixed lock push lock members perpendicularly from the transport direction of the cargo lane into openings in the bottom structure of the lowest tub in the stack of tub.

* * * * *